United States Patent [19]

Tomaro

[11] 3,937,543

[45] Feb. 10, 1976

[54] ELECTRICAL SWIVEL CONTACT ASSEMBLY

[75] Inventor: Patrick M. Tomaro, Maplewood, N.J.

[73] Assignee: Continental Hair Products, Inc., Edison, N.J.

[22] Filed: Jan. 29, 1975

[21] Appl. No.: 545,055

[52] U.S. Cl. ..... 339/6 R; 339/101; 339/181 C; 339/8 P

[51] Int. Cl.[2] ..... H01R 39/00

[58] Field of Search ..... 339/6 R, 6 A, 9 R, 8 R, 339/8 P, 101, 176 R, 177 R, 181 R, 181 C, 182 R, 182 RS

[56] References Cited

UNITED STATES PATENTS 1,407,937 2/1922 Fitzgerald ..... 339/8 P X 1,765,330 6/1930 Goldrick ..... 339/182 RS

*Primary Examiner*—Roy Lake
*Assistant Examiner*—DeWalden W. Jones
*Attorney, Agent, or Firm*—Alan H. Levine

[57] ABSTRACT

An assembly including a support plate carrying a contact member on each face. A power cord terminal has an electrically-conductive pin projecting through aligned holes in the support plate and contact members, and an electrically-conductive ring surrounding the pin and insulated from it. A spring cooperates with the pin to press the ring against one of the contact members and electrically connect the pin to the other contact member.

10 Claims, 3 Drawing Figures

ELECTRICAL SWIVEL CONTACT ASSEMBLY

This invention relates to an electrical swivel contact assembly which permits relative rotation between interconnected electrical terminals while permitting flow of electricity between the terminals.

The invention will be described in connection with an electrically-heated curling iron. However, it is to be understood that the invention may be used advantageously with other hand-held electrical appliances, and other types of electrically-powered apparatus.

When a curling iron is used, it is rotated about its longitudinal axis in order to coil hair around it. This rotation of the curling iron causes the electrical cord supplying electricity to it to become twisted. As time goes on, the twisted electrical cord becomes both an inconvenience and a danger. Therefore, it has been suggested in the past that curling irons include electrical swivel contact assemblies which permit rotation of the curling iron without twisting of the electrical cord. However, such swivel contact assemblies have been complex and expensive, both in the initial cost of materials and the cost of assembly.

It is, therefore, an object of the present invention to provide an electrical swivel contact assembly which is very simple, inexpensive, and easy to assemble.

It is another object of the invention to provide a swivel contact assembly in which one pair of relatively moving contacts is spring biased into engagement, the other pair of relatively moving contacts being electrically connected through the spring which provides the bias.

A further object of the invention is to provide a swivel contact assembly in which two contact members are mounted on a single support plate adapted to be fixed within the housing of an electrical appliance, these contact members being cooperable, respectively, with two coaxial electrically-conductive elements presented by a power cord terminal.

It is an additional object of the invention to provide such a swivel contact assembly wherein the power cord terminal and its electrically-conductive elements are rotatable with respect to the support plate and contact members which it carries, while good electrical contact is maintained between the electrically-conductive power cord elements and the two contact members, respectively.

Additional objects and features of the invention will be apparent from the following description, in which reference is made to the accompanying drawings:

Figure 1:
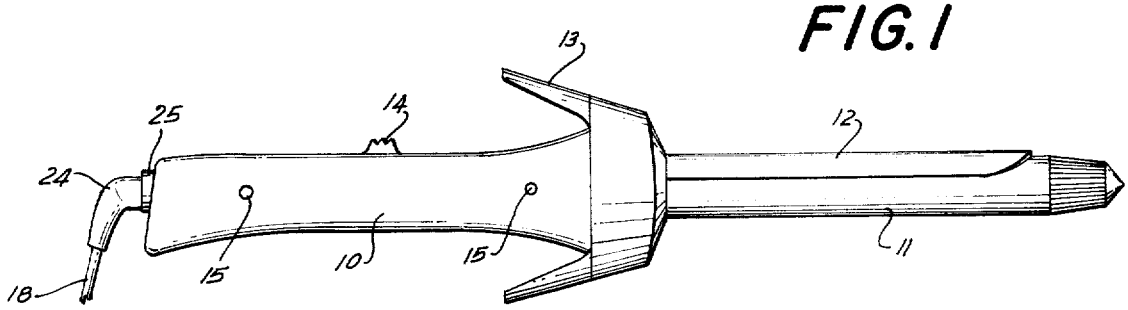
FIG. 1 is a side elevational view of an electrically-heated curling iron, as an example of the type of appliance with which the present invention may be employed.
Figure 2:
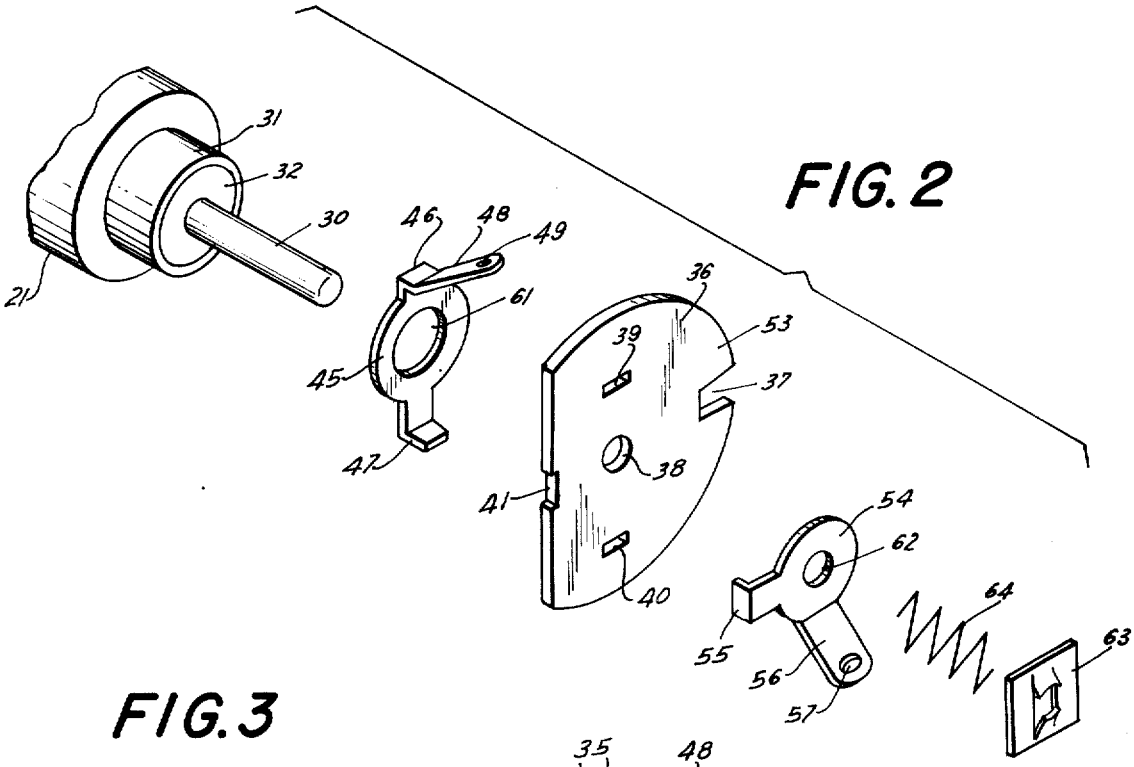
FIG. 2 is an exploded perspective view of an electrical swivel contact assembly according to the present invention.

The curling iron shown in FIG. 1 comprises a handle 10 made of plastic or other insulated material, and a tubular metal barrel 11, containing an electrical heating element (not shown), projecting from one end of handle 10. Clamping means 12, pivoted to handle 10 and operable by lever 13, serves to hold the end of a lock of hair to be curled. After the end of the lock of hair is clamped, the curling iron is rotated about the longitudinal axis of handle 10 and barrel 11 so as to coil the hair around the barrel and clamp. On handle 10 is a switch 14 for energizing and deenergizing the heating element within barrel 11. Handle 10 is made in two parts joined along a longitudinal line of separation and held together by screws 15.

An electrical power cord 18 extends from the end of handle 10 opposite barrel 11 and is provided at its free end with the usual plug (not shown) for insertion into an electrical receptacle to provide electrical power to the curling iron. Power cord 18 contains two electrically-conductive wires 19 and 20 which are electrically insulated from each other. At its end which joins handle 10, power cord 18 is provided with a terminal including a molded plastic part having an enlarged section 21, a reduced diameter section 22, a flange 23, and an angle body portion 24. Body portion 24 extends snugly but rotatably through a hole in the end of handle 10 surrounded by a boss 25.

Handle 10 is formed with an interior wall 28 having a hole 29 of diameter slightly larger than the diameter of power cord terminal section 22, but smaller than the diameters of flange 23 and enlarged section 21. As a result of the cooperation between wall 28 and section 22, the power cord terminal is free to rotate with respect to handle 10, but it cannot move longitudinally with respect to the handle.

Projecting from the inner end of enlarged section 21 is an electrically conductive pin 30 surrounded by an electrically conductive ring 31 which also projects from the inner end of section 21. The pin and ring are electrically insulated from each other by suitable insulative material 32. Pin 30 projects beyond ring 31, and is electrically connected to one of the wires in power cord 18, say wire 19. Ring 31 is electrically connected to the other wire in power cord 18, say wire 20.

Handle 10 is formed with two spaced-apart internal annular ridges 35. Fitted between ridges 35 is a support plate 36 of insulator material. Plate 36 is formed at its periphery with a notch 37 which accommodates an internal projection (not shown) in handle 10, the cooperation of notch and projection preventing relative rotation between support plate 36 and handle 10. Thus, support plate 36 is held stationary with respect to handle 10. Plate 36 has a central hole 38, two slots 39 and 40, and a notch 41 formed in a straight portion of the plate periphery.

Arranged against one face 44 of support plate 36 is an electrical contact member 45 in the form of a metal washer. Contact member 45 is provided with two diametrically projecting right-angle-bent fingers 46 and 47 which fit snugly in slots 39 and 40, respectively, in support plate 36. In this way, contact member 45 is prevented from rotating with respect to support plate 36. Finger 47 is extended to define a tab 48 having an aperture 49 for connecting contact member 45 to an electrical conductor 50 within handle 10.

Arranged against the other face 53 of support plate 36 is another contact member 54, also in the form of a metal washer. Contact member 54 is provided with a radially-projecting right-angle-bent finger 55 which fits snugly within notch 41 in support plate 36, and thereby prevents relative rotation between the support plate and contact member 54. Contact member 54 is also provided with a tab 56 having an aperture 57 for connecting contact member 54 to another electrical conductor 58 within handle 10.

Figure 3:
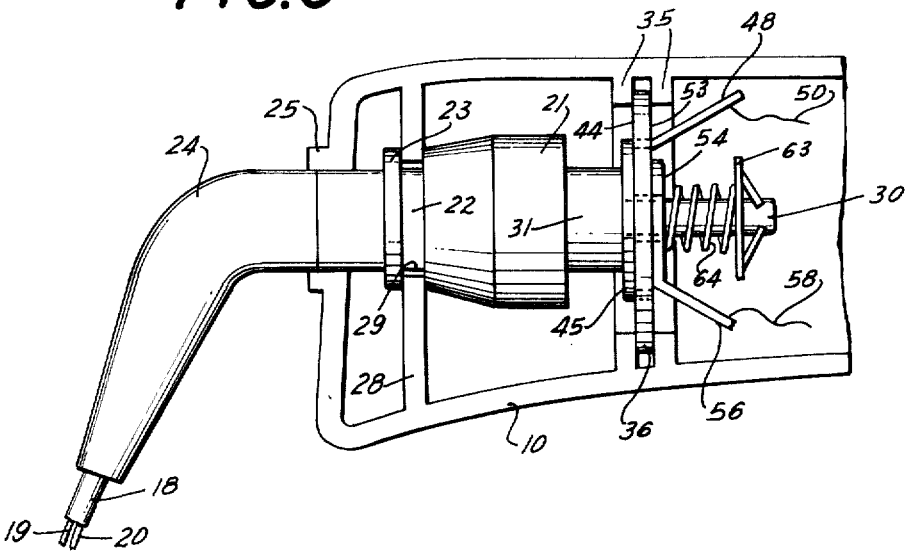
FIG.3 is a fragmentary view, on an enlarged scale, of the end of the curling iron handle where the electrical power cord enters the handle, one half of the handle being removed to show the interior.

The hole 61 in contact member 45, the hole 38 in support plate 36, and the hole 62 in contact member 54 are all aligned, and pin 30 of the power cord terminal passes through the aligned holes. A fastener 63 is mounted on pin 30 near its free end. In this example, fastener 63 is of the type which can be pushed on to pin 30 by moving it toward the left in FIG. 3, but which cannot be moved to the right with respect to pin 30 once it has been pushed on to the pin. A helical coil compression spring 64 surrounds pin 30 and bears at one end against fastener 63 and at the other end against contact member 54.

Spring 64 and fastener 63 serve two functions. First, the spring force operating on pin 30 through fastener 63 tends to urge the power cord terminal toward the right in FIG. 3 with respect to support plate 36. In this way, ring 31 is pressed against contact member 45. The pressure is such that good electrical contact is maintained between ring 31 and member 45, but relative rotation between these two parts is permitted. Secondly, spring 64 and fastener 63, both of which are made of electrically-conductive material, form an electrical connection between pin 30 and contact member 54. Thus, good electrical contact is maintained between pin 30 and contact member 54, but relative rotation between these two parts is permitted.

It will be appreciated, therefore, that by means of the swivel contact assembly of the present invention, wires 19 and 20 in power cord 18 are electrically connected to conductors 58 and 50 respectively, within handle 10, while relative rotation between the wires and conductors is permitted. As a result, when handle 10 is rotated about its longitudinal axis, during use of the curling iron, the power cord terminal rotates with respect to the handle, and prevents the power cord 18 from becoming twisted.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. An electrical swivel contact assembly comprising:

a. a support plate having a hole, b. two electrical contact members, one of said contact members being arranged against each face of said support plate, and each of said contact members having a hole aligned with the holes in said support plate and the other contact member, c. a power cord terminal having an electrically-conductive pin surrounded by an electrically-conductive ring, said pin and ring being electrically insulated from each other, and said pin projecting beyond said ring and through the aligned holes in said support plate and contact members, and d. resilient means for pressing said ring against one of said contact members and for electrically connecting said pin to the other of said contact members.

2. An electrical swivel contact assembly as defined in claim 1 wherein said resilient means includes an electrically-conductive fastener secured to said pin and an electrically-conductive spring extending between said fastener and said other contact member.

3. An electrical swivel contact assembly as defined in claim 2 wherein said spring is a helical coil spring surrounding said pin.

4. An electrical swivel contact assembly as defined in claim 1 including means for preventing relative rotation between said contact members and said support plate.

5. An electrical swivel contact assembly as defined in claim 4 wherein said rotation-preventing means includes a finger projecting from each of said contact members toward said support plate, and an aperture in said support plate for snugly accommodating each of said fingers.

6. An electrical swivel contact assembly as defined in claim 1 wherein the diameter of the hole in said one contact member is larger than the diameter of said pin so that said pin can pass through said hole without engaging said one contact member.

7. An electrical swivel contact assembly as defined in claim 1 including means for connecting an electrical conductor to each of said contact members.

8. An electrical swivel contact assembly as defined in claim 7 wherein said connecting means includes an apertured tab projecting from each of said contact members.

9. An electrical swivel contact assembly as defined in claim 1 wherein the swivel contact assembly is adapted for use in an electrical appliance having a housing, and means for preventing relative rotation between said support plate and the housing.

10. An electrical swivel contact assembly as defined in claim 9 wherein said power cord terminal includes means cooperating with the appliance housing for preventing relative longitudinal movement between said terminal and the housing while permitting relative rotation between said terminal and the housing.

* * * * *